US006903633B2

(12) United States Patent
Zhu et al.

(10) Patent No.: US 6,903,633 B2
(45) Date of Patent: Jun. 7, 2005

(54) ELECTRONIC TUNABLE FILTERS WITH DIELECTRIC VARACTORS

(75) Inventors: Yongfei Zhu, Columbia, MD (US); Louise C. Sengupta, Warwick, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/682,650

(22) Filed: Oct. 9, 2003

(65) Prior Publication Data

US 2004/0070471 A1 Apr. 15, 2004

Related U.S. Application Data

(62) Division of application No. 09/734,969, filed on Dec. 12, 2000, now Pat. No. 6,686,817.

(51) Int. Cl.[7] ..... H01P 1/20
(52) U.S. Cl. ..... 333/207; 333/202
(58) Field of Search ..... 333/207, 206, 333/202, 223

(56) References Cited

U.S. PATENT DOCUMENTS

| | | | | |
|---|---|---|---|---|
| 4,431,977 A | | 2/1984 | Sokola et al. | 333/206 |
| 4,620,168 A | | 10/1986 | Delestre et al. | 333/202 |
| 5,173,835 A | | 12/1992 | Cornett et al. | 257/310 |
| 5,283,462 A | | 2/1994 | Stengel | 257/595 |
| 5,312,790 A | | 5/1994 | Sengupta et al. | 501/137 |
| 5,427,988 A | | 6/1995 | Sengupta et al. | 501/137 |
| 5,486,491 A | | 1/1996 | Sengupta et al. | 501/137 |
| 5,495,215 A | | 2/1996 | Newell et al. | 333/202 |
| 5,502,422 A | | 3/1996 | Newell et al. | 333/207 |
| 5,614,875 A | | 3/1997 | Jang et al. | 333/202 |
| 5,635,433 A | | 6/1997 | Sengupta | 501/137 |
| 5,635,434 A | | 6/1997 | Sengupta | 501/138 |
| 5,693,429 A | | 12/1997 | Sengupta et al. | 428/699 |
| 5,766,697 A | | 6/1998 | Sengupta et al. | 427/585 |
| 5,830,591 A | | 11/1998 | Sengupta et al. | 428/701 |
| 5,846,893 A | | 12/1998 | Sengupta et al. | 501/137 |
| 5,965,494 A | | 10/1999 | Terashima et al. | 505/210 |
| 5,990,766 A | | 11/1999 | Zhang et al. | 333/205 |
| 6,011,446 A | | 1/2000 | Woods | 331/185 |
| 6,081,174 A | | 6/2000 | Takei et al. | 333/206 |
| 6,096,127 A | * | 8/2000 | Dimos et al. | 117/9 |
| 6,097,263 A | | 8/2000 | Mueller et al. | 333/17.1 |
| 6,101,102 A | | 8/2000 | Brand et al. | 363/15 |

FOREIGN PATENT DOCUMENTS

| | | | |
|---|---|---|---|
| EP | 0843374 A | | 5/1998 |
| JP | 62110301 A | | 5/1987 |
| JP | 10135708 A | | 5/1998 |
| WO | WO94/27376 | * | 11/1994 |
| WO | WO 98/20606 | | 5/1998 |
| WO | WO 00/35042 A | | 6/2000 |

OTHER PUBLICATIONS

U.S. Appl. No. 09/594,837, filed Jun. 15, 2000, Chiu et al.
*Patent Abstracts of Japan*, vol. 011, No. 320 (E–550), Oct. 17, 1987 & JP 62 110301 A (Matsushita Electric Ind. Co. Ltd.), May 21, 1987.

(Continued)

*Primary Examiner*—Stephen E. Jones
(74) *Attorney, Agent, or Firm*—Robert P. Lenari; James S. Finn

(57) ABSTRACT

A radio frequency electronic filter includes an input, an output, and first and second resonators coupled to the input and the output, with the first resonator including a first voltage tunable dielectric varactor and the second resonator including a second voltage tunable dielectric varactor. The resonators can include a lumped element resonator, a ceramic resonator, or a microstrip resonator. Additional voltage tunable dielectric varactors can be connected between the input and the first resonator and between the second resonator and the output. Voltage tunable dielectric varactors can also be connected between the first and second resonators.

26 Claims, 10 Drawing Sheets

OTHER PUBLICATIONS

*Patent Abstracts of Japan*, vol. 1998, No. 10, Aug. 31, 1998 & JP 10 135708 A (Kyocera Corp.), May 22, 1998.

V. N. Keis et al., "20 GHz Tunable Filter Based on Ferroelectric (Ba,Sr)$TiO_3$ Film Varactors," *Electronics Letters, IEE*, vol. 34, No. 11, May 28, 1998, pp. 1107–1109.

O. G. Vendik et al., "Ferroelectric Tuning of Planar and Bulk Microwave Devices," *Journal of Superconductivity*, vol. 12, No. 2, Apr. 1999, pp. 325–338.

* cited by examiner

ELECTRONIC TUNABLE FILTERS WITH DIELECTRIC VARACTORS

CROSS-REFERENCE TO RELATED APPLICATION

This application is a divisional of patent Ser. No. 09/734,969, entitled, "ELECTRONIC TUNABLE FILTERS WITH DIELECTRIC VARACTORS", filed Dec. 12, 2000, by Yongfei Zhu et al., that issued as U.S. Pat. No. 6,686,817 on Feb. 3, 2004.

BACKGROUND OF INVENTION

The present invention generally relates to electronic filters and, more particularly, to such filters that include tunable dielectric capacitors (dielectric varactors).

One of most dramatic developing areas in communications over the past decade has been mobile and portable communications. This has led to continual reductions in the size of the terminal equipment such as the handset phone. Size reduction of the electronic circuits is progressing with the development of recent semiconductor technologies. However, microwave filters occupy a large volume in communications circuits, especially in multi-band applications. Multi-band applications typically use fixed filters to cover different frequency bands, with switches to select among the filters. Therefore, compact, high performance tunable filters are extremely desirable for these applications, to reduce the number of filters and simplify the control circuits.

Electrically tunable filters are suitable for mobile and portable communication applications, compared to other tunable filters such as mechanically and magnetically tunable filters. Both mechanically and magnetically tunable filters are relatively large in size and heavy in weight. Electronically tunable filters have the important advantages of small size, lightweight, low power consumption, simple control circuits, and fast tuning capability. Electronically tunable filters can be divided into two types: one is tuned by tunable dielectric capacitors (dielectric varactors), and the other is tuned by semiconductor diode varactors. The dielectric varactor is a voltage tunable capacitor in which the dielectric constant of a dielectric material in the capacitor can be changed by a voltage applied thereto. Compared to semiconductor diode varactors, dielectric varactors have the merits of lower loss, higher power-handling, higher IP3, and faster tuning speed. Third intermodulation distortion happens when two close frequency signals (f1 and f2) are input into a filter. The two signals generate two related signals at frequencies of 2f2−f1 (say f3), and 2f1−f2 (say f4), in addition to the two main signals f1 and f2. F3 and f4 should be as low as possible compared to f1 and f2. The relationship between f1, f2, f3 and f4 is characterized by IP3. The higher the IP3 value is, the lower the third intermodulation. Considering the additional attributes of low power consumption, low cost, variable structures, and compatibility to integrated circuit processing, dielectric varactors are suitable for tunable filters in mobile and portable communication applications.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material—BSTO—MgO"; U.S. Pat. No. 5,486,491 to Sengupta, et al. entitled "Ceramic Ferroelectric Composite Material—BSTO—$ZrO_2$"; U.S. Pat. No. 5,635,434 to Sengupta, et al. entitled "Ceramic Ferroelectric Composite Material—BSTO-Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material—BSTO—ZnO". These patents are hereby incorporated by reference. A copending, commonly assigned U.S. patent application Ser. No. 09/594,837, filed Jun. 15, 2000, discloses additional tunable dielectric materials and is also incorporated by reference. The materials shown in these patents, especially BSTO—MgO composites, show low dielectric loss and high tunability. Tunability is defined as the fractional change in the dielectric constant with applied voltage.

Commonly used compact fixed filters in mobile and portable communications are ceramic filters, combline filters, and LC-lumped filters. This invention provides tunable filters, utilizing advanced dielectric varactors.

SUMMARY OF THE INVENTION

Radio frequency electronic filters constructed in accordance with this invention include an input, an output, and first and second resonators coupled to the input and the output, with the first resonator including a first tunable dielectric varactor and the second resonator including a second tunable dielectric varactor. The resonators can take the form of a lumped element resonator, a ceramic resonator, or a microstrip resonator. Additional tunable dielectric varactors can be connected between the input and the first resonator and between the second resonator and the output. Tunable dielectric varactors can also be connected between the first and second resonators. Further embodiments include additional resonators and additional tunable dielectric varactors.

The compact tunable filters of this invention are suitable for mobile and portable communication applications such as handset phones. The high Q dielectric varactors used in the preferred embodiments of the invention utilize low loss tunable thin film dielectric materials.

DETAILED DESCRIPTION OF THE INVENTION

Figure 1:
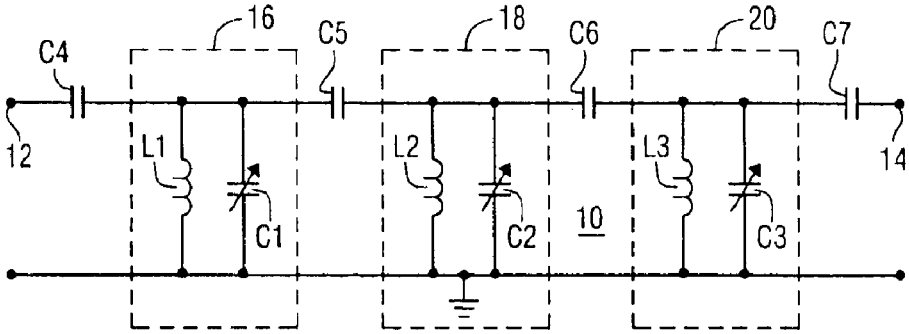
FIG. 1 is a schematic diagram of a lumped element LC tunable filter constructed in accordance with one embodiment of the invention.

Referring to the drawings, FIG. 1 is a schematic diagram of a three pole lumped element LC tunable filter 10 constructed in accordance with one embodiment of the invention. The filter includes an input 12 and an output 14. A plurality of resonant circuits 16, 18 and 20 are electrically coupled to the input and the output. Resonant circuit 16 includes inductor L1 and capacitor C1. Resonant circuit 18 includes inductor L2 and capacitor C2. Resonant circuit 20 includes inductor L3 and capacitor C3. Capacitor C4 couples resonant circuit 16 to the input 12. Capacitor C5 couples resonant circuit 16 to resonant circuit 18. Capacitor C6 couples resonant circuit 18 to resonant circuit 20. Capacitor C7 couples resonant circuit 20 to the output 14. Capacitors C1, C2 and C3 are tunable dielectric varactors. C4 and C7 are port coupling capacitors used to provide a specific port impedance, typically 50 ohms or 75 ohms. More or fewer resonators can be used in the filter to obtain specific filter rejection. Each of the tunable varactors is connected to a voltage bias circuit not shown in FIG. 1, but shown in FIG. 2 as bias circuit 22.

Figure 2:
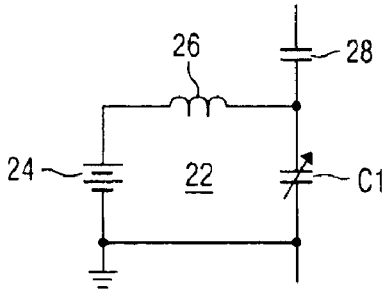
FIG. 2 is a schematic diagram of a DC bias circuit for varactors used in the filters of this invention.

FIG. 2 shows a voltage source 24 connected to varactor C1 through an inductor 26. A blocking capacitor 28 is electrically connected in series with the varactor. By varying the voltage supplied by source 24, the capacitance of the varactor changes. This enables tuning of the filter. The DC blocking capacitor is used to prevent the DC bias voltage from entering into the other parts of the filter. Inductor 26 works as an RF choke to prevent RF signal leaking into the bias circuit.

Figure 3:
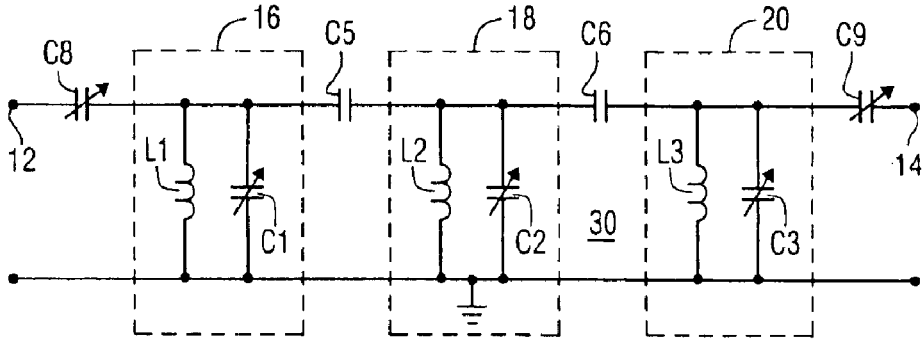
FIG. 3 is a schematic diagram of another lumped element LC tunable filter constructed in accordance with the invention.

FIG. 3 is a schematic diagram of another lumped element LC tunable filter 30 constructed in accordance with the invention. Filter 30 is similar to filter 10 of FIG. 1, except that capacitors fixed C4 and C7 in FIG. 1 have been replaced by varactors C8 and C9 in FIG. 3.

Figure 4:
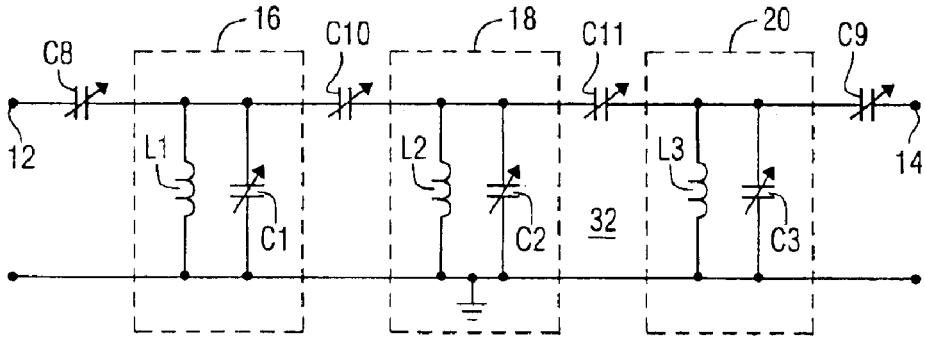
FIG. 4 is a schematic diagram of another lumped element LC tunable filter constructed in accordance with the invention.

FIG. 4 is a schematic diagram of another lumped element LC tunable filter 32 constructed in accordance with the invention. Filter 32 is similar to filter 30 of FIG. 3, except that capacitors fixed C5 and C6 in FIG. 3 have been replaced by varactors C10 and C11 in FIG. 4.

The lumped element tunable filters of FIGS. 1–4 are particularly applicable for use in mobile and portable communications. Lumped element tunable filters have the advantages of small size, simple structure, and low cost. In order to tune the filters, the fixed resonating capacitors in a conventional LC lumped element filter are replaced by dielectric varactors. The tuning range of the filter is determined by the tuning range of the varactors. In order to control the frequency response (such as bandwidth and return loss) in the tuning range, the coupling between resonators and resonator-ports may be tunable. To do so, varactors may replace the fixed port coupling capacitors, as shown in FIGS. 3 and 4. FIG. 4 shows a fully controlled filter for controlling center frequency, bandwidth, and return loss in the tuning range. Since each capacitance in the filter is tunable, the lumped element tunable filter of FIG. 4 has the highest tuning range compared to other tunable filters for a certain varactor tuning range. However, LC lumped element filters suffer from high insertion losses, and frequency limitations caused by lumped element behaviors vs. frequency.

In the preferred embodiments of the invention, each of the filters includes varactors comprising a substrate, a first conductor positioned on a surface of the substrate, a second conductor positioned on the surface of the substrate and forming a gap between the first and second conductors, a tunable dielectric material positioned on the surface of the substrate and within the gap, the tunable dielectric material having a top surface, with at least a portion of said top surface being positioned above the gap opposite the surface of the substrate, and a first portion of the second conductor extending along at least a portion of the top surface of the tunable dielectric material. The second conductor can overlap or not overlap a portion of the first conductor.

Figure 5:
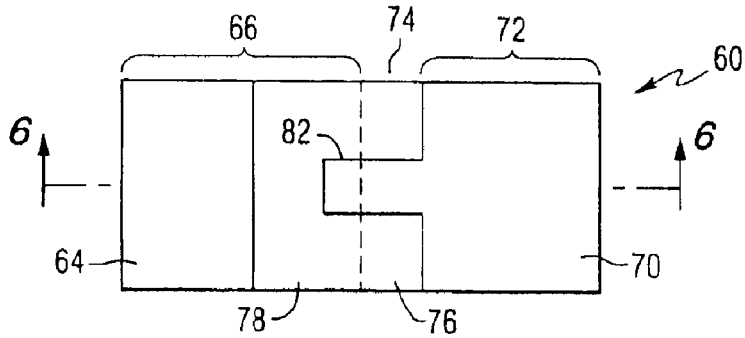
FIG. 5 is a plan view of a varactor that can be used in filters constructed in accordance with the present invention.
Figure 6:
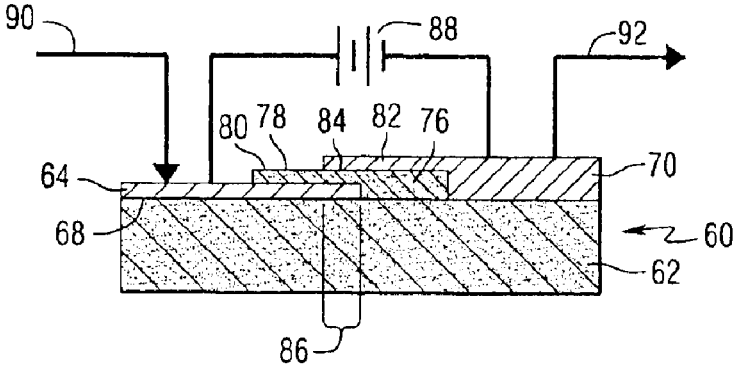
FIG. 6 is a sectional view of the varactor of FIG. 5 taken along line 6—6.

FIGS. 5 and 6 are top plan and cross-sectional views of a varactor 60 that can be used in filters constructed in accordance with the present invention. The varactor includes a substrate 62 and a first electrode 64 positioned on first portion 66 of a surface 68 of the substrate. A second electrode 70 is positioned on second portion 72 of the surface 68 of the substrate and separated from the first electrode to form a gap 74 therebetween. A tunable dielectric material 76 is positioned on the surface 68 of the substrate and in the gap between the first and second electrodes. A section 78 of the tunable dielectric material 76 extends along a surface 80 of the first electrode 64 opposite the substrate. The second electrode 70 includes a projection 82 that is positioned on a top surface 84 of the tunable dielectric layer opposite the substrate. In this embodiment of the invention projection 82 has a rectangular shape and extends along the top surface 84 such that it vertically overlaps a portion 86 of the first electrode. The second electrode can be referred to as a "T-type" electrode. A DC bias voltage, as illustrated by voltage source 88, is applied to the electrodes 64 and 70 to control the dielectric constant of the tunable dielectric material lying between the electrodes 64 and 70. An input 90 is provided for receiving an electrical signal and an output 92 is provided for delivering the signal.

The tunable dielectric layer 76 can be a thin or thick film. The capacitance of the varactor of FIGS. 5 and 6 can be expressed as:

$$C = \varepsilon_o \varepsilon_r \frac{A}{t}$$

where C is capacitance of the capacitor; $\in_o$ is permittivity of free-space; $\in_r$ is dielectric constant (permittivity) of the tunable film; A is area of the electrode 64 that is overlapped by electrode 70; and t is thickness of the tunable film in the overlapped section. An example of these parameters for a 1 pF capacitor is: $\in_r$=200; A=170 $\mu m^2$; and t=0.3 $\mu$m. The horizontal distance (HD) along the surface of the substrate between the first and second electrodes is much greater than the thickness (t) of the dielectric film. Typically, thickness of tunable film is <1 micrometer for thin films, and <5 micrometers for thick film, and the horizontal distance is greater than 50 micrometers. Theoretically, if the horizontal distance is close to t, the capacitor will still work, but its capacitance would be slightly greater than that calculated from the above equation. However, from a processing technical view, it is difficult and not necessary to make the horizontal distance close to t. Therefore, the horizontal distance mainly depends on the processing used to fabricate the device, and is typically about >50 micrometers. In practice, we choose HD>10t.

The substrate layer 62 may be comprised of MgO, alumina ($Al_2O_3$), $LaAlO_3$, sapphire, quartz, silicon, gallium arsenide, and other materials that are compatible with the various tunable films and the electrodes, as well as the processing used to produce the tunable films and the electrodes.

The bottom electrode 64 can be deposited on the surface of the substrate by electron-beam, sputtering, electroplating or other metal film deposition techniques. The bottom electrode partially covers the substrate surface, which is typically done by etching processing. The thickness of the bottom electrode in one preferred embodiment is about 2 $\mu$m. The bottom electrode should be compatible with the substrate and the tunable films, and should be able to withstand the film processing temperature. The bottom electrode may typically be comprised of platinum, platinum-rhodium, ruthenium oxide or other materials that are compatible with the substrate and tunable films, as well as with the film processing. Another film may be required between the substrate and bottom electrode as an adhesion layer, or buffer layer for some cases, for example platinum on silicon can use a layer of silicon oxide, titanium or titanium oxide as a buffer layer.

The thin or thick film of tunable dielectric material 76 is then deposited on the bottom electrode and the rest of the substrate surface by techniques such as metal-organic solution deposition (MOSD or simply MOD), metal-organic chemical vapor deposition (MOCVD), pulse laser deposition (PLD), sputtering, screen printing and so on. The thickness of the thin or thick film that lies above the bottom electrode is preferably in range of 0.2 $\mu$m to 4 $\mu$m. It is well known that the performance of a varactor depends on the quality of the tunable dielectric film. Therefore low loss and high tunability films should be selected to achieve high Q and high tuning of the varactor. In the varactors used in the preferred embodiment of the invention, these tunable dielectric films have dielectric constants of 2 to 1000, and tuning of greater than 20% with a loss tangent less than 0.005 at around 2 GHz. To achieve low capacitance, low dielectric constant (k) films should be selected. However, high k films usually shows high tunability. The typical k range is about 100 to 500.

In the preferred embodiment the tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. Other tunable dielectric materials may be used partially or entirely in place of barium strontium titanate. An example is $Ba_xCa_{1-x}TiO_3$, where x ranges from 0.2 to 0.8, and preferably from 0.4 to 0.6. Additional alternative tunable ferroelectrics include $Pb_xZr_{1-x}TiO_3$ (PZT) where x ranges from 0.05 to 0.4, lead lanthanum zirconium titanate (PLZT), lead titanate ($PbTiO_3$), barium calcium zirconium titanate ($BaCaZrTiO_3$), sodium nitrate ($NaNO_3$), $KNbO_3$, $LiNbO_3$, $LiTaO_3$, $PbNb_2O_6$, $PbTa_2O_6$, $KSr(NbO_3)$, and $NaBa_2(NbO_3)_5$ and $KH_2PO_4$.

The second electrode 70 is formed by a conducting material deposited on the surface of the substrate and at least partially overlapping the tunable film, by using similar processing as set forth above for the bottom electrode. Metal etching processing can be used to achieve specific top electrode patterns. The etching processing may be dry or wet etching. The top electrode materials can be gold, silver, copper, platinum, ruthenium oxide or other conducting materials that are compatible with the tunable films. Similar to the bottom electrode, a buffer layer for the top electrode could be necessary, depending on electrode-tunable film system. Finally, a part of the tunable film should be etched away to expose the bottom electrode.

Figure 7:
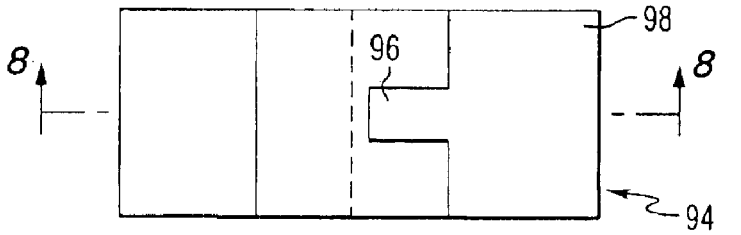
FIG. 7 is a plan view of another varactor that can be used in filters constructed in accordance with the present invention.
Figure 8:
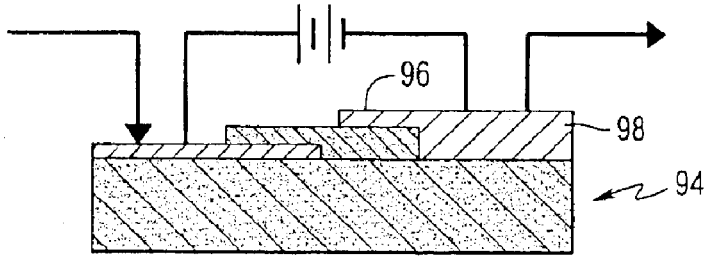
FIG. 8 is a sectional view of the varactor of FIG. 7 taken along line 8—8.

For a certain thickness and dielectric constant of the tunable dielectric film, the pattern and arrangement of the top electrode are key parameters in determining the capacitance of the varactor. In order to achieve low capacitance, the top electrode may have a small overlap (as shown in FIGS. 5 and 6) or no overlap with the bottom electrode. FIGS. 7 and 8 are top plan and cross-sectional views of a varactor 94, that can be used in filters of the invention, having a T-type top electrode with no overlap electrode area. The structural elements of the varactor of FIGS. 7 and 8 are similar to the varactor of FIGS. 5 and 6, except that the rectangular projection 96 on electrode 98 is smaller and does not overlap electrode 64. Varactors with no electrode overlap area may need more tuning voltage than those in which the electrodes overlap.

Figure 9:
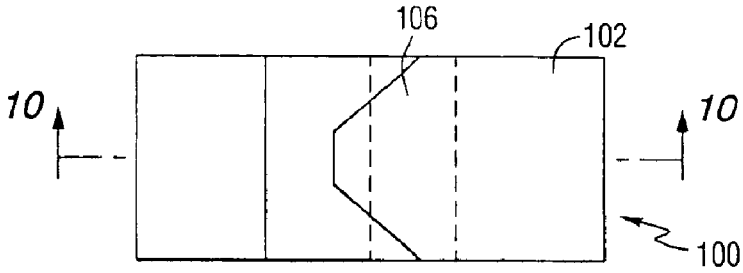
FIG. 9 is a plan view of another varactor that can be used in filters constructed in accordance with the present invention.
Figure 10:
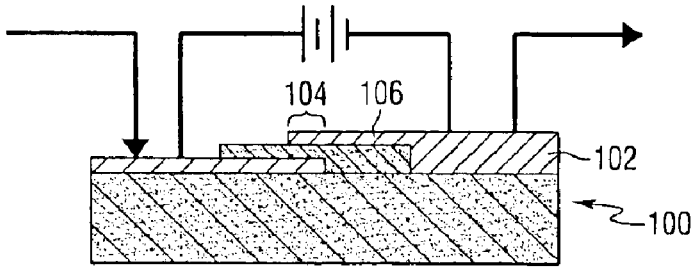
FIG. 10 is a sectional view of the varactor of FIG. 9 taken along line 10—10.
Figure 11:
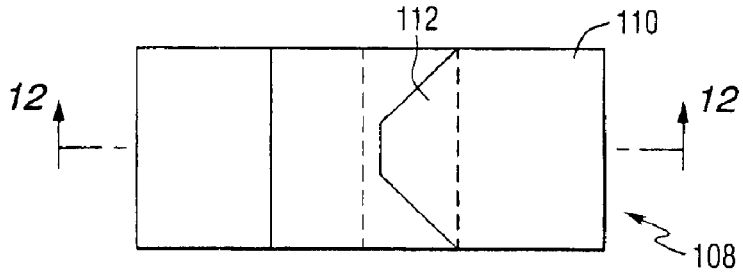
FIG. 11 is a plan view of another varactor that can be used in filters constructed in accordance with the present invention.
Figure 12:
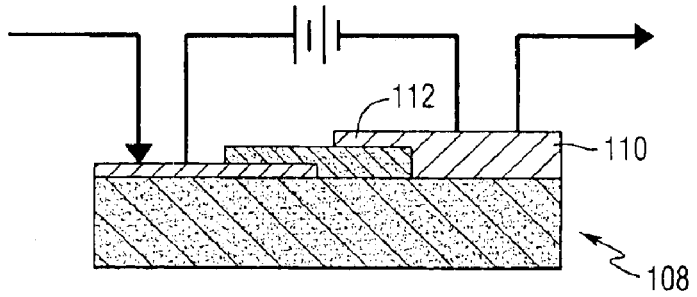
FIG. 12 is a sectional view of the varactor of FIG. 11 taken along line 12—12.

FIGS. 9 and 10 are top plan and cross-sectional views of a varactor 100, that can be used in filters of the invention, having a top electrode 102 with a trapezoid-type projection 106 and an overlapped electrode area 104. The structural elements of the varactor of FIGS. 9 and 10 are similar to the varactor of FIGS. 5 and 6, except that the projection 106 on electrode 102 has a trapezoidal shape. Since the projection on the T-type electrode of the varactor of FIGS. 5 and 6 is relatively narrow, the trapezoid-type top electrode of the varactor of FIGS. 9 and 10 is less likely to break, compared to the T-type pattern varactor. FIGS. 11 and 12 are top plan and cross-sectional views of a varactor 108 having a trapezoid-type electrode 110 having a smaller projection 112 with no overlap area of electrodes to obtain lower capacitance.

Figure 13:
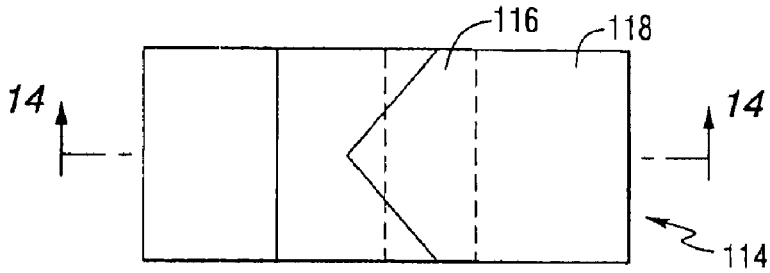
FIG. 13 is a plan view of another varactor that can be used in filters constructed in accordance with the present invention.
Figure 14:
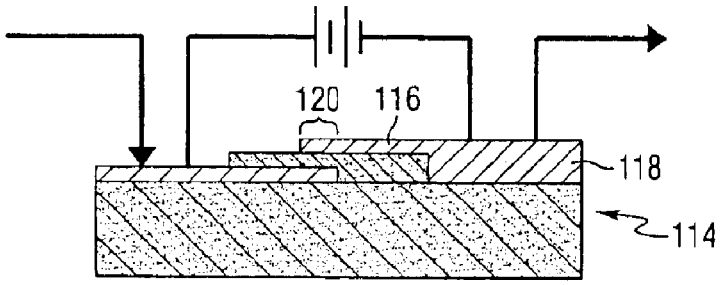
FIG. 14 is a sectional view of the varactor of FIG. 13 taken along line 14—14.
Figure 15:
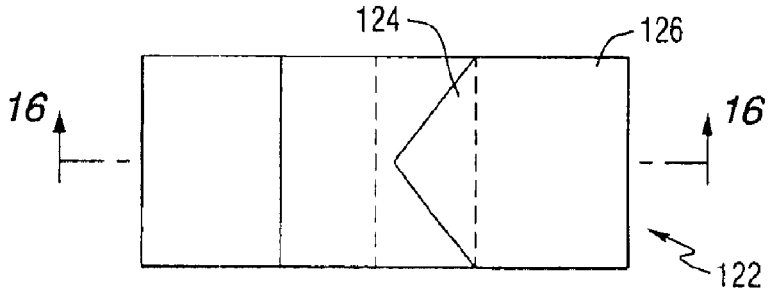
FIG. 15 is a plan view of another varactor that can be used in filters constructed in accordance with the present invention.
Figure 16:
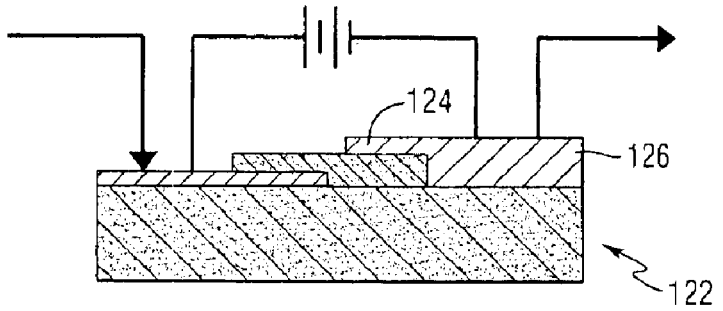
FIG. 16 is a sectional view of the varactor of FIG. 15 taken along line 16—16.

FIGS. 13 and 14 are top plan and cross-sectional views of a varactor 114, that can be used in filters of the invention, having triangle-type projection 116 on the top electrode 118 that overlaps a portion of the bottom electrode at region 120. Using a triangle projection on the top electrode may make it easier to reduce the overlap area of electrodes. FIGS. 15 and 16 are top plan and cross-sectional views of a varactor 122 having triangle-type projection 124 on the top electrode 126 that does not overlap the bottom electrode.

The invention uses voltage tunable thick film and thin film varactors that can be used in room temperature. Vertical structure dielectric varactors with specific electrode patterns and arrangements as described above are used to achieve low capacitance in the present invention. Variable overlap and no overlap structures of the bottom and top electrodes are designed to limit effective area of the vertical capacitor. Low loss and high tunability thin and thick films are used to improve performance of the varactors. Combined with the low loss and high tunability materials, the varactors have low capacitance, higher Q, high tuning, and low bias voltage.

Figure 17:
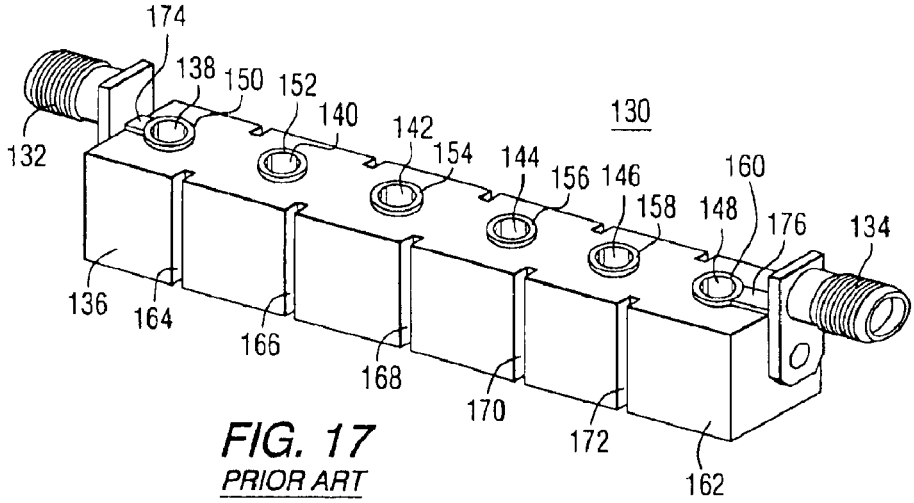
FIG. 17 PRIOR ART
FIG. 17 is an isometric view of a prior art ceramic filter that can be modified to include tunable varactors in accordance with the present invention.
Figure 18:
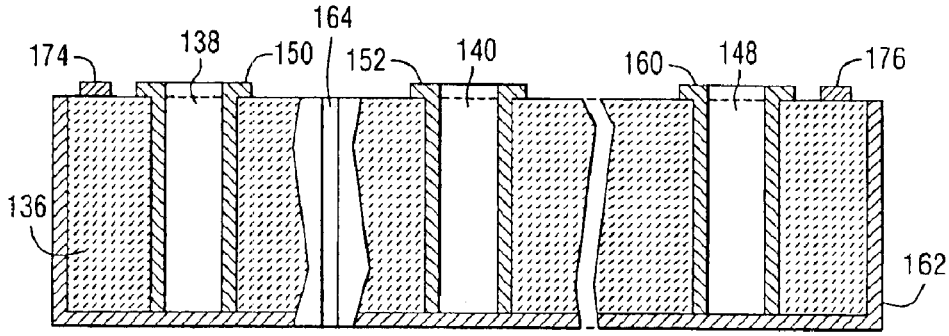
FIG. 18 PRIOR ART
FIG. 18 is a longitudinal vertical cross sectional view of the filter of FIG. 17.

FIG. 17 is an isometric view of a prior art ceramic filter 130 that can be modified to include tunable varactors in accordance with the present invention. FIG. 18 is a longitudinal vertical cross sectional view of the filter of FIG. 17. Filter 130 includes an input 132 and an output 134, each coupled to a block 136 of ceramic material. The ceramic block includes a plurality of openings 138, 140, 142, 144, 146 and 148, extending from its top surface to its bottom surface with each hole lined by a metal tube 150, 152, 154, 156, 158 and 160. The dielectric block is covered with a conductive material 162 with the exception of portions near one end of each hole and near the first and second electrodes. Slots 164, 166, 168, 170 and 172 are cut into the sides of the conductive material and the ceramic block. Tabs 174 and 176 are used to connect the ceramic block to the input and output connectors.

Figure 19:
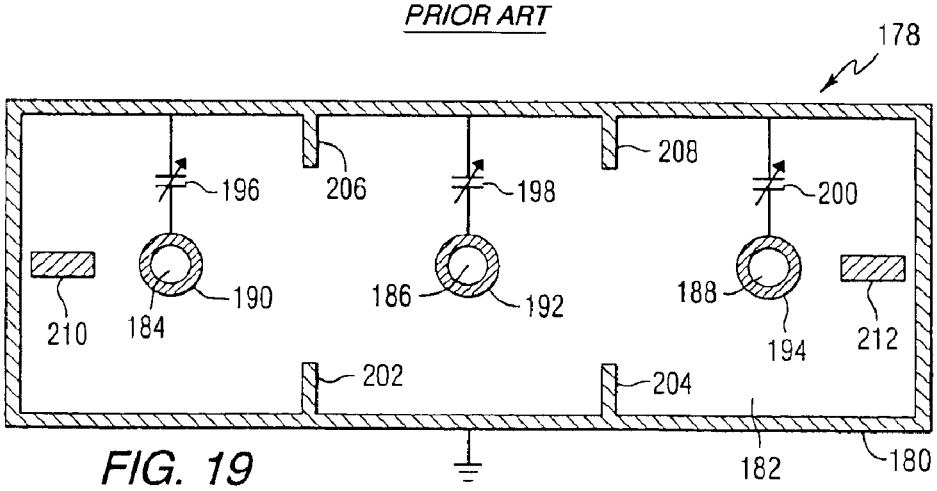
FIG. 19 is a top plan view of ceramic filter with a schematically illustrated varactor constructed in accordance with the present invention.

To make the conventional filter tunable, a dielectric varactor is shunted on the top surface of each of the resonators, as shown in FIG. 19. The detailed bias circuit for each dielectric varactor is similar to that for LC lumped element tunable filter as shown in FIG. 2. FIG. 19 is a top plan view of ceramic filter 178 with a schematically illustrated varactor constructed in accordance with the present invention. The filter 178 includes a metallic housing 180 that holds a ceramic block 182. Holes 184, 186 and 188 are positioned in the ceramic block 182. Metallic tubes 190, 192 and 194 line the holes. Dielectric varactors 196, 198 and 200 couple tubes 190, 192 and 194 respectively, to the housing. Projections 202, 204, 206 and 208 extend from the housing into the ceramic block. Tabs 210 and 212 are used to connect the input and output of the filter to an external circuit.

Figure 20:
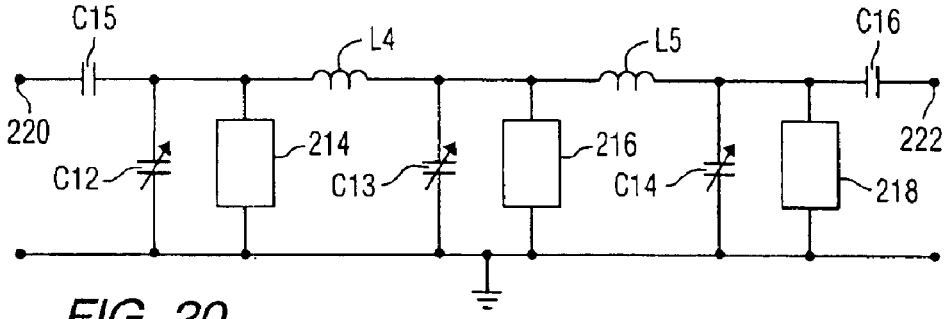
FIG. 20 is a schematic diagram of the filter of FIG. 19.

FIG. 20 is a schematic diagram of the filter of FIG. 19. The filter is shown to include three resonant circuits 214, 216 and 218. The resonant circuits are coupled by inductors L4 and L5. Dielectric varactors C12, C13 and C14 are electrically connected in parallel with resonant circuits 214, 216 and 218, respectively. Capacitor C15 couples the input 220 to the first resonant circuit 214. Capacitor C16 couples the output 222 to the third resonant circuit 218. Since the capacitance contributed by the dielectric varactors is a part of the capacitance in each resonator, tuning of varactor can tune the resonating frequency.

Figure 21:
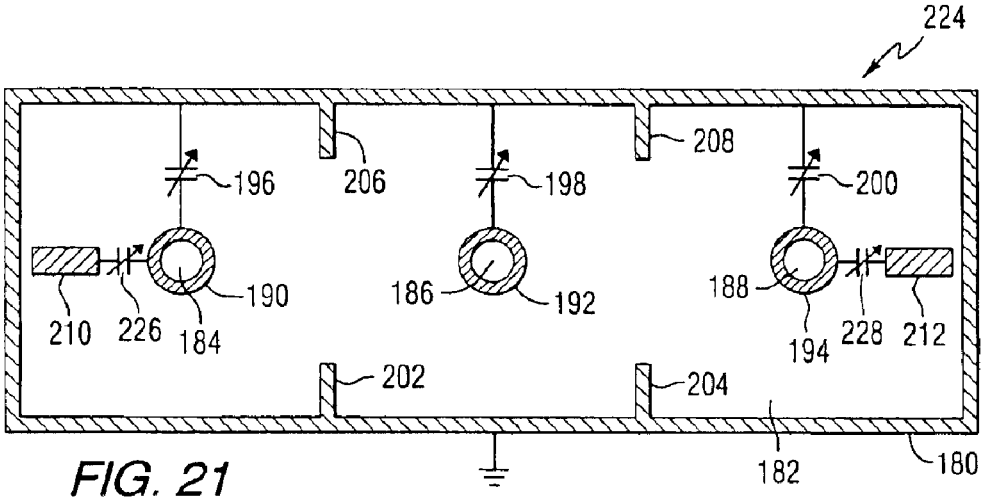
FIG. 21 is a top plan view of another ceramic filter with a schematically illustrated varactor constructed in accordance with the present invention.

In order to more accurately control filter performance in tuning range, dielectric varactors may be added to the port couplings as well as resonator couplings to tune the couplings. FIG. 21 is a top plan view of another ceramic filter 224 with schematically illustrated varactors constructed in accordance with the present invention. The filter of FIG. 21 is similar to that of FIG. 19, with the addition of dielectric varactors 226 and 228. Dielectric varactor 226 couples tube 190 to the input tab 210 and dielectric varactor 228 couples tube 194 to the output tab 212.

Figure 22:
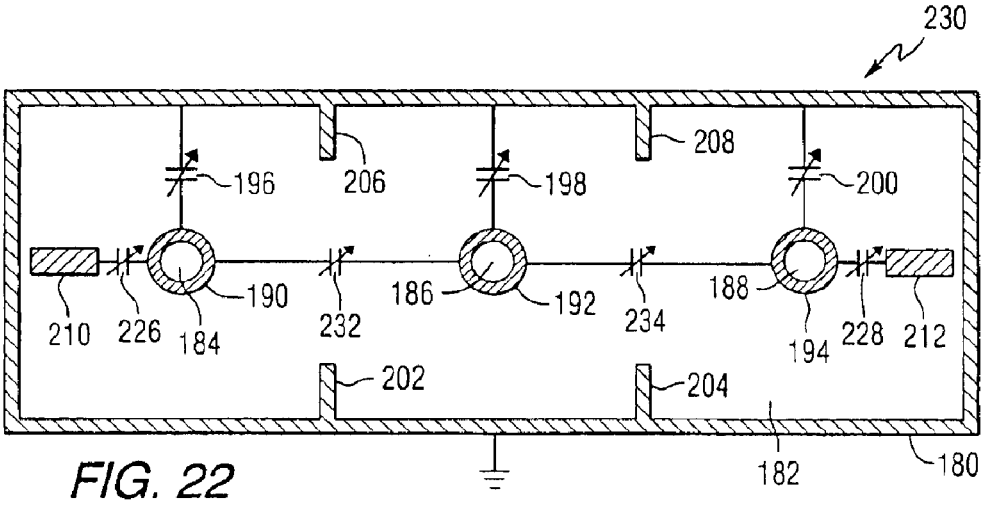
FIG. 22 is a top plan view of another ceramic filter with a schematically illustrated varactor constructed in accordance with the present invention.

FIG. 22 is a top plan view of another ceramic filter 230 with schematically illustrated varactors constructed in accordance with the present invention. The filter of FIG. 22 is similar to that of FIG. 21, with the addition of dielectric varactors 232 and 234. Dielectric varactor 232 couples tube 190 to the tube 192 and dielectric varactor 228 couples tube 192 to tube 194.

This tunable ceramic tunable filter should have low insertion loss, compact size, and low cost. It should be noted that the ceramic filters of this invention are not limited to those shown in FIGS. 19, 21 and 22. Any fixed ceramic filters can be modified into tunable filters, as long as the dielectric varactors can be shunted between the resonating hole and its ground plane.

Figure 23:
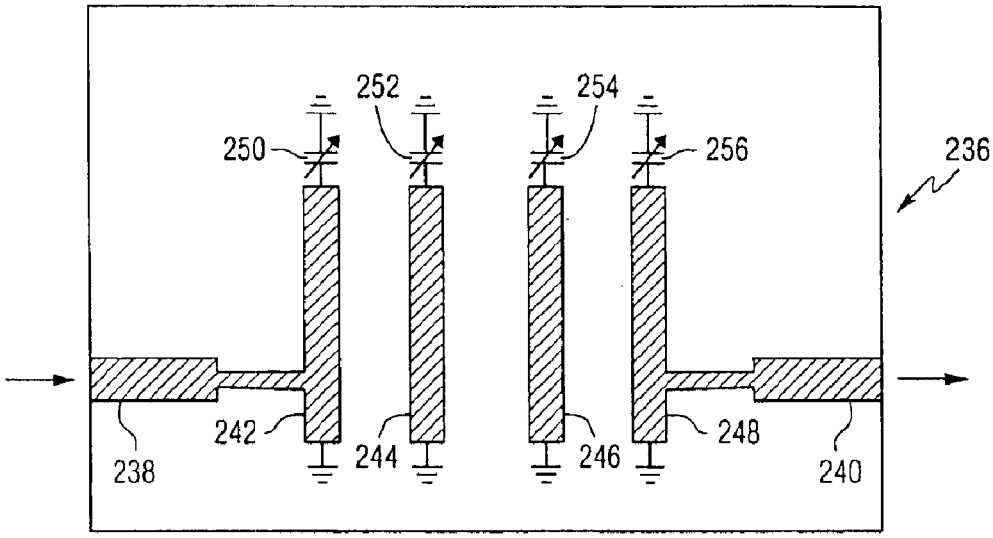
FIG. 23 is a schematic representation of a combline filter constructed in accordance with the present invention.

FIG. 23 is a schematic representation of a microstrip combline filter 236 constructed in accordance with the present invention. Filter 236 includes an input 238 and an output 240. A plurality of resonators are formed by microstrips 242, 244, 246 and 248. Each resonator is comprised of a microstrip line, a capacitor, and two short-circuited ends. Dielectric varactors 250, 252, 254 and 256 connect the microstrips to ground. The bias circuit for each varactor is not shown for clarity, but would be similar to that for LC lumped element tunable filter as shown in FIG. 2.

Figure 24:
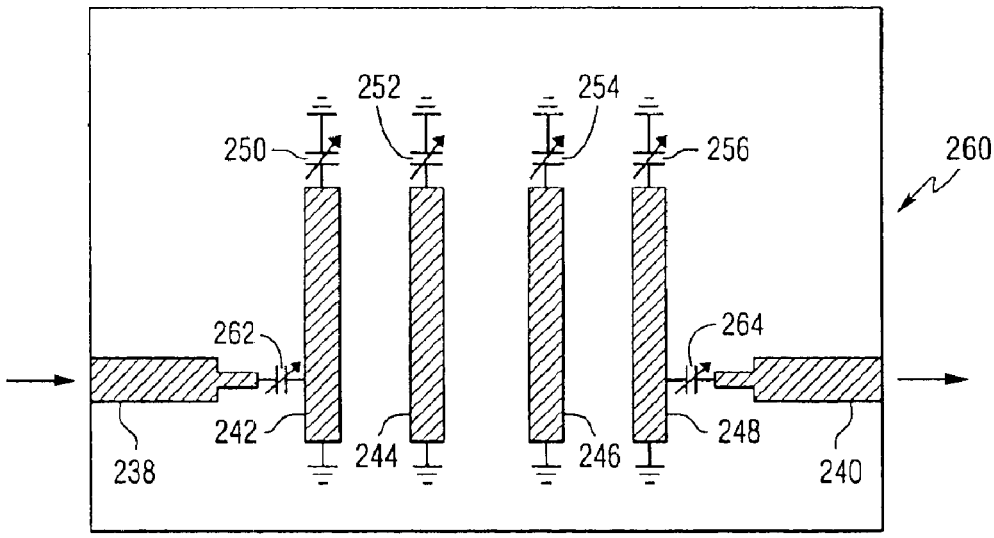
FIGS. 24, 25, 26 and 27 are schematic representations of additional combline filters constructed in accordance with the present invention.

FIGS. 24, 25, 26 and 27 are schematic representations of additional combline filters constructed in accordance with the present invention. FIG. 24 is a top plan view of another ceramic filter 260 with schematically illustrated varactors constructed in accordance with the present invention. The filter of FIG. 24 is similar to that of FIG. 23, with the addition of dielectric varactors 262 and 264. Dielectric varactor 262 couples microstrip 242 to the input 238 and dielectric varactor 264 couples microstrip 248 to the output 240.

Figure 25:
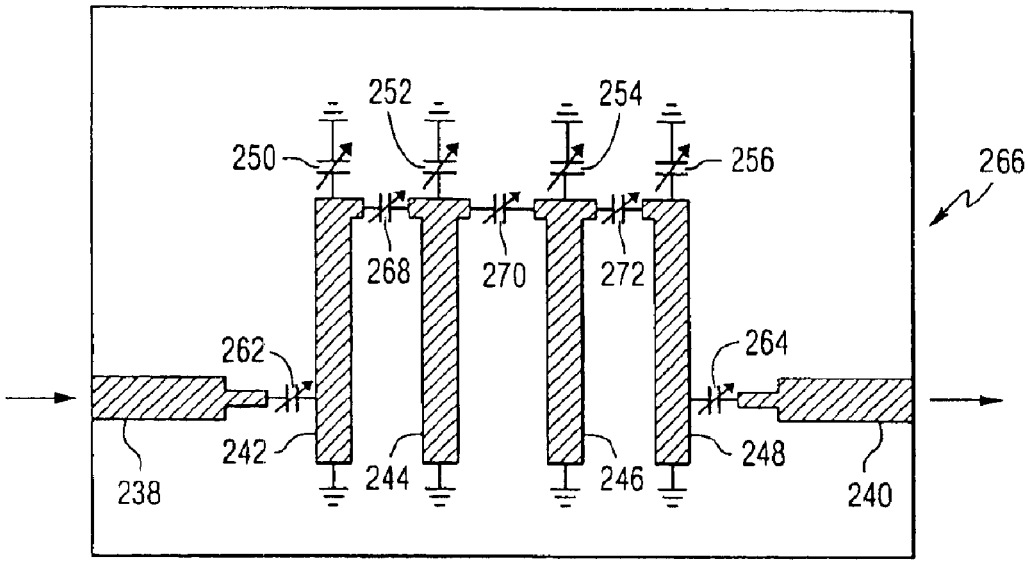

FIG. 25 is a top plan view of another ceramic filter 266 with schematically illustrated varactors constructed in accordance with the present invention. The filter of FIG. 25 is similar to that of FIG. 24, with the addition of dielectric varactors 268, 270 and 272. Dielectric varactor 268 couples microstrip 242 to microstrip 244, dielectric varactor 270 couples microstrip 244 to microstrip 242 and dielectric varactor 272 couples microstrip 246 to microstrip 242.

Figure 26:
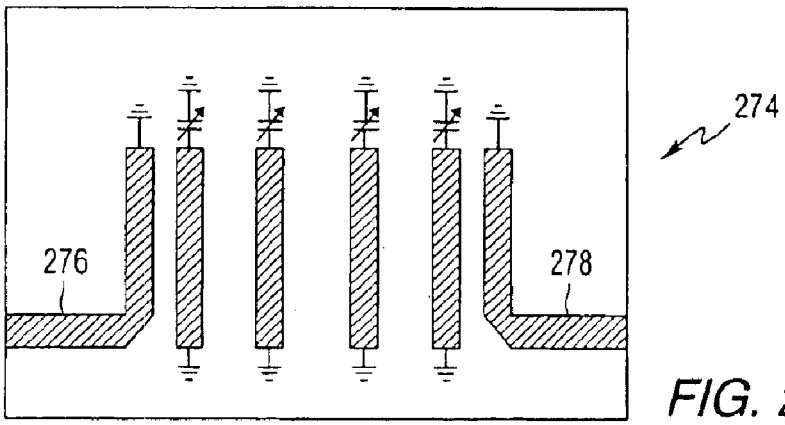

FIG. 26 is a top plan view of another ceramic filter 274 with schematically illustrated varactors constructed in accordance with the present invention. Filer 274 is similar to that shown in FIG. 23, except for the use of transformer coupled input 276 and output 278.

Figure 27:
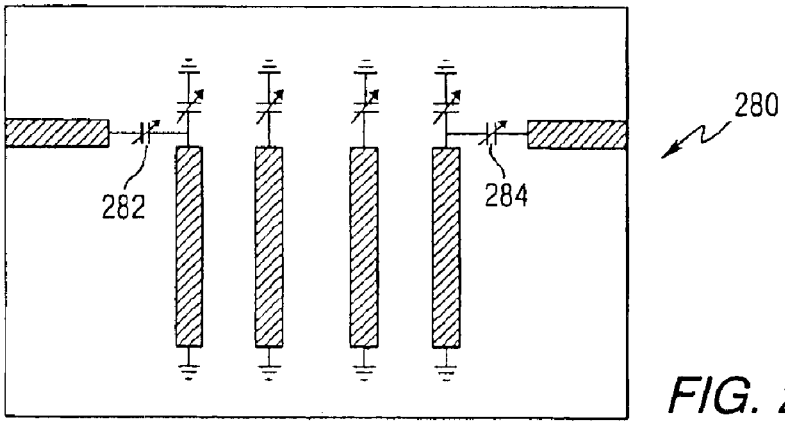

FIG. 27 is a top plan view of another ceramic filter 280 with schematically illustrated varactors constructed in accordance with the present invention. Filer 280 is similar to that shown in FIG. 24, except for the connection points for dielectric varactors 282 and 284.

The port couplings can be tunable, as shown in FIG. 24, as well as resonator coupling (FIG. 25), to improve filter performance in tuning range. It should be also noted that the invention is not limited to tapped combline filters as shown in FIG. 23, but encompasses transformer, capacitive loaded, and others combline filters, shown in FIGS. 24, 25, 26 and 27.

It is an object of the present invention to provide relatively compact, high performance tunable filters for mobile and portable communication as well as other applications. Tunable filters with ceramic filters, combline filters, and LC-lumped element filters are disclosed as examples of the dielectric varactor applications. The dielectric varactors may be located in resonators and/or in couplings in the filters to make filter tunable and to optimize performance of the filter during tuning processing.

Figure 28:
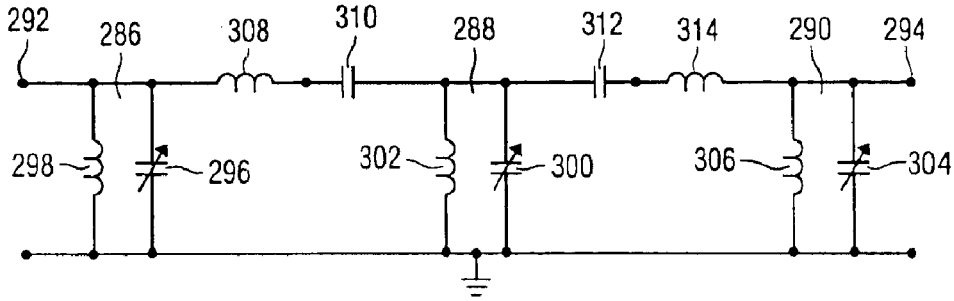
FIGS. 28 and 29 are schematic diagrams of other lumped element LC tunable filters constructed in accordance with the invention.
Figure 29:
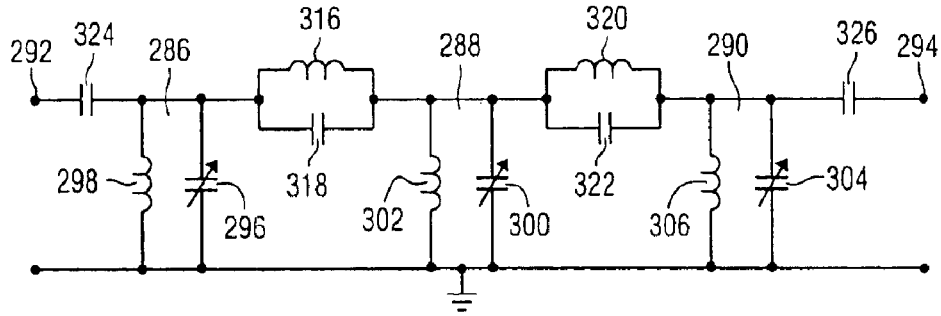

It should be noted that the lumped element filters are not limited to those discussed above. Some examples of other filter structures are illustrated in FIGS. 28 and 29. In the filter of FIG. 28, resonators 286, and 290 are coupled to input 292 and output 294. Resonator 286 includes the parallel connection of varactor 296 and inductor 298. Resonator 288 includes the parallel connection of varactor 300 and inductor 302. Resonator 290 includes the parallel connection of varactor 304 and inductor 306. Resonators 286 and 288 are coupled to each other by a series circuit including inductor 308 and capacitor 310. Resonators 288 and 290 are coupled to each other by a series circuit including inductor 312 and capacitor 314.

The filter of FIG. 29 is similar to that of FIG. 28 except that the resonators 286 and 288 are coupled by a parallel connection of inductor 316 and capacitor 318, and resonators 288 and 290 are coupled by a parallel connection of inductor 320 and capacitor 322. In addition, resonator 286 is coupled to the input be capacitor 324 and resonator 290 is coupled to the output by capacitor 326. In FIGS. 28 and 29, some or all of the capacitors can be replaced with dielectric varactors in accordance with the invention.

RF microwave filters typically include multiple resonators with specific resonating frequencies. These adjacent resonators are coupled to each other by reactive coupling. In addition, the RF signal input and output are coupled to the first and last resonator with a specific port impedance. The resonator is electrically equivalent to an LC circuit. Either a change of capacitance or a change in inductance of the resonator can shift the resonating frequency.

Accordingly, the present invention, by utilizing the unique application of high Q tunable dielectric varactor capacitors, provides high performance electronically tunable filters. Several tunable filter structures have been described as illustrative embodiments of the present invention. However, it will be apparent to those skilled in the art that these examples can be modified without departing from the scope of the invention, which is defined by the following claims.

What is claimed is:

1. A radio frequency electronic filter comprising:

an input;

an output;

first and second resonators coupled to the input and the output;

the first resonator including a first voltage tunable dielectric varactor;

the second resonator including a second voltage tunable dielectric varactor, each of the first and second voltage tunable dielectric varactors comprising a tunable dielectric layer capable of being operated at room temperature, wherein each of the first and second voltage tunable varactors comprise a first electrode and a second electrode, wherein the tunable dielectric layer at least partially fills a gap defined between the second electrode and the first electrode, wherein the first and second resonators comprise:

a ceramic block defining at least two openings extending from a top surface of the ceramic block toward a bottom surface of the ceramic block.

2. The radio frequency filter according to claim 1, wherein one of the dielectric varactors is connected between each of the openings and an outside surface of the ceramic block.

3. The radio frequency filter according to claim 2, further comprising:

a first electrode positioned a predetermined distance from a first one of the openings;

a second electrode positioned a predetermined distance from a second one of the openings;

a third dielectric varactor coupled between the first electrode and the first one of openings; and a fourth dielectric varactor coupled between the second electrode and the second one of the openings.

4. The radio frequency filter according to claim 3, wherein the varactor comprises a substrate and a first electrode positioned on a first portion of a surface of the substrate; and a second electrode positioned on second portion of the surface of the substrate and separated from the first electrode to form a gap therebetween; and wherein a tunable dielectric material may be positioned on the surface of the substrate and in the gap between the first and second electrodes.

5. The radio frequency filter according to claim 4, wherein section of the tunable dielectric material extends along a surface of the first electrode opposite the substrate and wherein the second electrode includes a projection that is positioned on a top surface of the tunable dielectric layer opposite the substrate forming a rectangular shape and extending along the top surface such that it vertically overlaps a portion of the first electrode.

6. The radio frequency filter according to claim 3, wherein the second electrode may be a "T-type" electrode.

7. The radio frequency filter according to claim 3, further comprising a trapezoidal projection on the second electrode.

8. The radio frequency filter according to claim 3, further comprising a triangle-type projection on the second electrode.

9. The radio frequency filter according to claim 1, wherein the top surface of the ceramic block is partially metallized.

10. The radio frequency filter according to claim 1, wherein the tunable dielectric layer may be a thin or thick film.

11. A radio frequency electronic filter comprising:

an input;

an output; and a resonator electrically coupled to the input and the output, the resonator comprising a voltage tunable dielectric varactor comprising:

a substantially planar substrate layer;

a substantially planar first electrode comprising a first side and an opposing second side, the first side positioned parallel to and adjacent to a first portion of the substantially planar substrate layer;

a substantially planar projection of a tunable dielectric layer that is substantially parallel with and adjacent to the second side of the first electrode, the tunable dielectric layer electrically tunable at room temperature; and a second electrode comprising a substantially planar projection that overlaps and is positioned substantially parallel to the first electrode, wherein the second electrode is separated from the first electrode by the substantially planar projection of the tunable dielectric layer.

12. The radio frequency filter according to claim 11, wherein the substantially planar projection of the second electrode is rectangular.

13. The radio frequency filter according to claim 11, wherein the substantially planar projection of the second electrode is trapezoidal.

14. The radio frequency filter according to claim 11, wherein the substantially planar projection of the second electrode is triangular.

15. The radio frequency filter according to claim 11, wherein the substantially planar projection of the tunable dielectric layer is less than about five micrometers thick.

16. The radio frequency filter according to claim 11, wherein the tunable dielectric layer has a dielectric constant of between 2 and 1000.

17. The radio frequency filter according to claim 11, wherein the tunable dielectric layer comprises BSTO.

18. The radio frequency filter according to claim 11, wherein the tunable dielectric layer comprises BSTO—$CaTiO_3$.

19. The radio frequency filter according to claim 11, wherein the tunable dielectric layer comprises BSTO—$MgTiO_3$.

20. The radio frequency filter according to claim 11, wherein the tunable dielectric layer comprises BSTO—MgO.

21. The radio frequency filter according to claim 11, wherein the tunable dielectric layer comprises BSTO—$MgAl_2O_4$.

22. The radio frequency filter according to claim 11, wherein the tunable dielectric layer comprises BSTO—$MgSrZrTiO_6$.

23. The radio frequency filter according to claim 11, wherein the tunable dielectric layer comprises PZT.

24. The radio frequency filter according to claim 11, wherein the first tunable dielectric layer comprises PLZT.

25. The radio frequency filter according to claim 11, wherein the first tunable dielectric layer comprises barium calcium zirconium titanate.

26. The radio frequency filter according to claim 11, wherein the first tunable dielectric layer comprises $KSrNbO_3$.

* * * * *